US006198701B1

(12) United States Patent
De Jonghe et al.

(10) Patent No.: US 6,198,701 B1
(45) Date of Patent: Mar. 6, 2001

(54) ELECTROCHEMICAL TIMER

(75) Inventors: Lutgard C. De Jonghe, Lafayette; May-Ying Chu, Oakland, both of CA (US)

(73) Assignee: PolyPlus Battery Company, Inc., Berkeley, CA (US)

( * ) Notice: Subject to any disclaimer, the term of this patent is extended or adjusted under 35 U.S.C. 154(b) by 0 days.

(21) Appl. No.: 09/148,027

(22) Filed: Sep. 3, 1998

(51) Int. Cl.[7] ..... G04F 1/00
(52) U.S. Cl. ..... 368/327; 116/206
(58) Field of Search ..... 368/107, 90, 327; 200/206

(56) References Cited

U.S. PATENT DOCUMENTS

| | | | | |
|---|---|---|---|---|
| 4,103,296 | * | 7/1978 | Hart et al. | 368/114 |
| 4,153,345 | | 5/1979 | Duchene et al. | 350/363 |
| 4,277,974 | * | 7/1981 | Karr et al. | 73/339 R |
| 4,382,700 | * | 5/1983 | Youngren | 368/327 |
| 4,804,275 | | 2/1989 | Kang et al. | 347/162 |
| 4,860,269 | * | 8/1989 | Hennings et al. | 368/107 |
| 4,929,090 | * | 5/1990 | Grahm | 368/114 |
| 5,250,905 | | 10/1993 | Kuo et al. | 324/435 |
| 5,339,024 | | 8/1994 | Kuo et al. | 324/435 |
| 5,396,177 | | 3/1995 | Kuo et al. | 324/435 |
| 5,418,086 | | 5/1995 | Bailey | 429/93 |
| 5,500,759 | | 3/1996 | Coleman | 359/270 |
| 5,912,759 | | 6/1999 | Good et al. | 359/297 |
| 5,930,023 | | 7/1999 | Mitchell, Jr. et al. | 359/270 |

* cited by examiner

*Primary Examiner*—Bernard Roskoski
(74) *Attorney, Agent, or Firm*—Beyer Weaver & Thomas, LLP

(57) ABSTRACT

An electrochemical timer is described that is compact, lightweight, inexpensive to manufacture, and simple to use in which the consumption of reactive materials in an electrochemical reaction provides a visual indication of the passage of time. In one embodiment, the electrochemical timer includes a first electrode, an electrolyte, and a second electrode. The electrodes and electrolyte are chosen such that the first electrode is consumed at a predetermined rate upon electrochemical contact of the electrodes and electrolyte. The electrodes and electrolyte are further configured such that the consumption of the first electrode can be monitored to provide an indication of the passage of time. In one embodiment, the electrochemical timers provided herein are used to monitor the shelf-life of perishables.

28 Claims, 7 Drawing Sheets

ELECTROCHEMICAL TIMER

1 BACKGROUND OF THE INVENTION

1.1 Field of the Invention

The present invention relates to electrochemical devices, and, more specifically, to electrochemically-powered devices. Still more specifically, the present invention relates to electrochemically -powered timing devices. The invention has applications in the areas of time keeping and alarms.

1.2 The Related Art

Many aspects of our modem economy require managing ephemeral items. Goods such as foodstuffs have only a limited shelf-life before they become unsaleable or rancid. Substances such as blood can be placed in storage for only a relatively short time before becoming unusable. Files may contain information that is time-sensitive or hold papers that must be acted upon before the expiration of a specified period. The availability of a service or resource, such as access to the Internet or a parking stall, may be regulated or charged in terms of fixed chronological periods.

In each case noted above, there is a requirement of time management. In some cases this is performed by marking an item, e.g., with a "Sell By", "Use By", or "Process By" date that must be compared, usually manually, with the current date to determine availability or priority. In other cases, a meter, such as a stopwatch or countdown timer, is used to regulate charges or access. In general, however, the efforts required to manage time-sensitive items require a great deal of manual labor as some chronological indicator, such as a time stamp, must be read and compared to the current time before a determination of whether the time period in question has expired can be made.

In addition, the use of a fixed time period may be arbitrary and only crudely related to the relevant time period. For example, the rate at which foodstuffs spoil is a function of several variables, including temperature and humidity. However, present technology cannot provide freshness indicators sophisticated enough to account for such factors. Instead, a fixed period is provided for the sale of perishables even though that period may be suboptimal and lead to the needless destruction of great quantities of food.

Thus, technologies that can ease the determination of the expiration of a fixed time period have great practical utility. However, the application of current time keeping technologies such as electronic timers or alarms to the maintenance of goods sold in bulk or regulating access to services or resources is often cost prohibitive and/or cumbersome. For example, the construction of electronic devices for warning of the expiration of a time period requires various components and portable power sources that are relatively expensive to fabricate and assemble. Such devices also would likely be too bulky for the application to mass-produced goods perishables such as meat and dairy products. In addition, these devices cannot vary the rate of timing to account for external variables.

Thus, there is a need for a chronological device that is inexpensive to assemble, compact, lightweight, and provides a relatively succinct indication of the expiration of a time period. In addition, in some cases it would be preferable to provide timers that can also reflect ambient conditions such as temperature and humidity. The present invention meets these and other needs.

2 SUMMARY OF THE INVENTION

The present invention provides electrochemical timers that are compact, lightweight, inexpensive to manufacture and simple to use. More particularly, the present invention provides, in a first aspect, an electrochemical timer in which the consumption of reactive materials in an electrochemical reaction provides a visual indication of the passage of time. Thus, the present invention provides a timer in which the consumption of the energy source that powers the timer also provides the indication of the passage of time.

In one embodiment, the electrochemical timer of the present invention includes a first electrode, an electrolyte, and a second electrode. The first and second electrodes and the electrolyte are chosen such that when these components are brought into electrochemical contact, the first electrode is consumed at a predetermined rate. The electrodes and electrolyte are further configured such that the consumption of the first electrode can be monitored to provide an indication of the passage of time. In one embodiment, the passage of time is determined by viewing the consumption of the first electrode through a viewing window provided in a timer housing. A perceptible message or indicator can be provided. In one embodiment, this message or indicator appears during the consumption of the first electrode.

In a more specific embodiment of the timer of the invention, the timer includes a means for isolating the electrodes from electrochemical contact. In a still more specific embodiment, the means includes one or more containers that retain the electrolyte so that electrochemical contact between the first and second electrodes is enabled when the electrolyte is released from the container(s). In a still more specific embodiment, the containers are rupturable. In other embodiments, the timer of the invention includes a resistor. The resistor can be temperature- or pressure-sensitive.

In a second aspect, the present invention provides an indication or the increased risk of food spoilage. According to one embodiment of this aspect of the invention, a perishable foodstuff is provided in a food container. An electrochemical timer of the invention is affixed to the container. The timer is configured such that activation of the timer, e.g., by rupturing one or more electrolyte-containing capsules, causes the first electrode of the timer to be substantially consumed over the shelf-life of the foodstuff. The timer further includes a perceptible warning or indicator as the first electrode is consumed. The timer is activated to initiate the electrochemical reaction between the electrodes. Thus, the present invention provides an inexpensive, reliable, and relatively accurate means for determining the shelf-life of a perishable foodstuff.

These and other aspects and advantages will become apparent when the Description below is read in conjunction with the accompanying Drawings.

3 BRIEF DESCRIPTION OF THE DRAWINGS

FIG. 1A and FIG. 1B show two views of an embodiment of an electrochemical timer in accordance with the present invention. FIG. 1A is an exploded view of an embodiment of an electrochemical timer in accordance with the present invention. FIG. 1B is a cut-away view of the embodiment shown in FIG. 1A.

4 DESCRIPTION OF SOME EMBODIMENTS OF THE INVENTION

4.1 Overview

The present invention provides electrochemical timers that are compact, lightweight, inexpensive to manufacture and simple to use. The electrochemical timers of the invention include first and second electrodes and an electrolyte that are chosen such that when the electrodes and electrolyte are in electrochemical contact, i.e., produce a current flow from one electrode to the other, the first electrode is substantially consumed during the period of contact at a predetermined rate. The electrodes and electrolyte are further configured to be monitored to provide an indication of the passage of time. Using such devices provided by the invention highly inexpensive, portable, and simple timers can be applied to many applications requiring chronological monitoring, such as monitoring the shelf-life of perishable goods.

4.2 Construction of the Electrochemical Timer

Figure 1A:
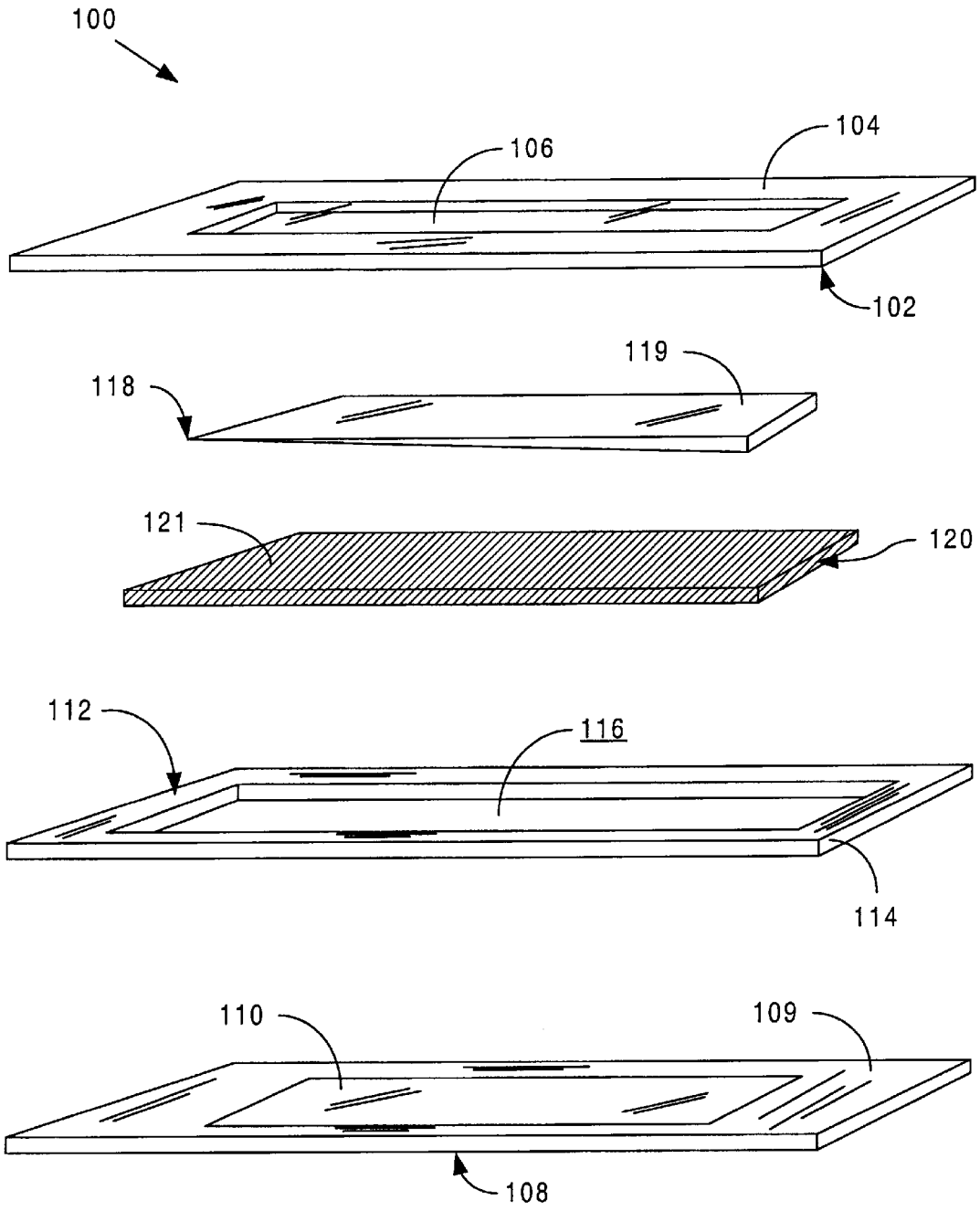
Figure 1B:
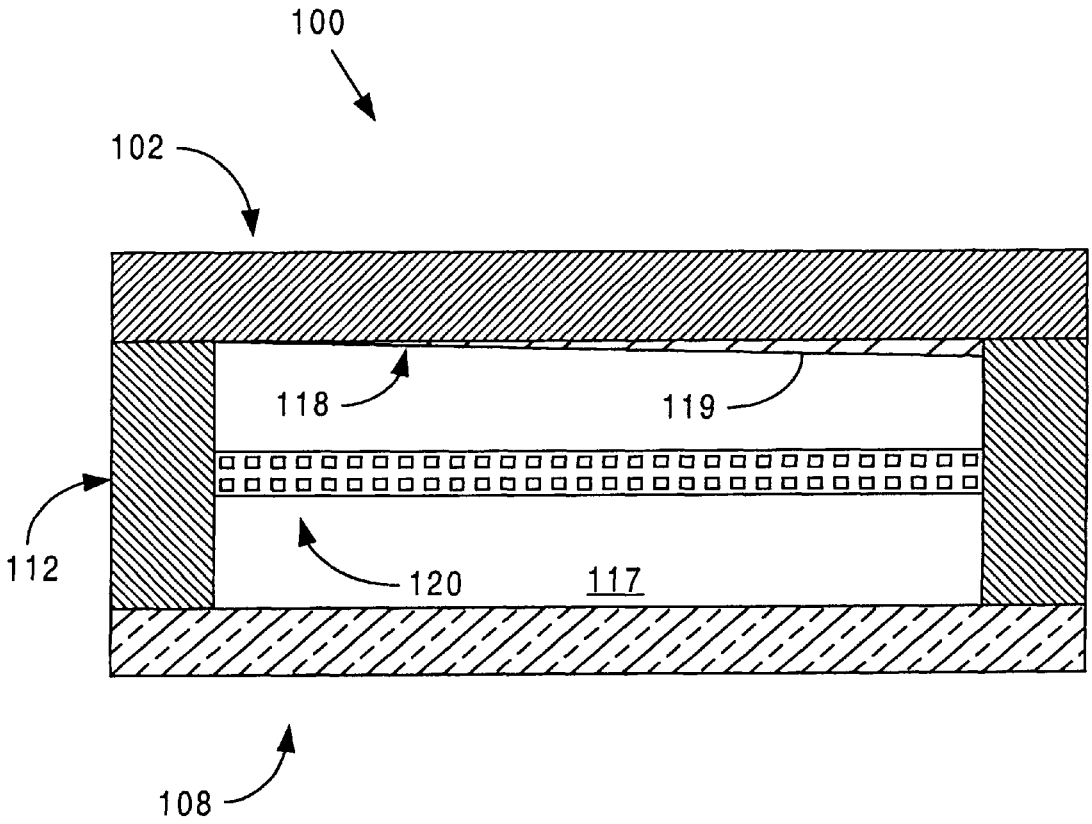

FIGS. 1A and 1B illustrates an embodiment of one such a self-powered electrochemical, or coulombic, timer provided by the present invention at 100. The illustrated embodiment includes a first surface 102 having an outer surface 104 through which is provided a viewing port 106. A second surface 108 having coupled on the interior face 109 thereof an electrode 110 is also provided. The first and surfaces can be made from any material or combination of materials that function as current collectors, are impervious to leakage of the battery components (described below), and can be fashioned or combined to allow a viewing port so that the progress of the electrochemical reaction within the timer can be monitored as described in detail below.

First and second surfaces 102 and 108 function as current collectors, as described more fully in Section 4.4 below, and can be made using methods and materials well known among those skill in the battery arts. In one embodiment, first surface 102 is constructed from one or more optically transparent materials such polyethyleneptherepthalate ("PET"), polypropylene, or polyethylene. However, non-transparent materials can be used also with an allowance made to provide a viewing port. In one embodiment, first surface 102 is between about 5 micrometers ("$\mu$m") and about 25 $\mu$m thick. In a more particular embodiment, the thickness of surface is between about 8 $\mu$m and about 16 $\mu$m, and, in an exemplary embodiment, about 12 $\mu$m thick. A viewing port, such as viewing port 106, can be created by either leaving the entire outer surface 104 uncovered or unpainted, so that contents of the cell beneath outer surface 104 can be viewed, or by providing a cover or coating on outer surface 104 that provides an area of transparency so that the gauge material 118 (described below) can be viewed. Alternatively, a first opaque material can be used to form surface 102 and an aperture provided with a window for viewing port 106. In addition, the exterior face of second surface 108 can include one or more elements for affixing the timer of the invention to a surface (not shown). Such elements can include, but are not limited to, magnets, adhesive elements, Velcro®, straps, clips, snaps or the like.

In one embodiment, the interior face of first surface 102 and second surface 108 is coated with a transparent, colorless, conductive material such as indium-tin oxide ("ITO"). Other suitable transparent or semitransparent conductive materials will be familiar to those of skill in the electrochemistry arts. Examples of such materials include, but are not limited to, metal films and even noble or semi-noble metals, such as nickel (Ni) and copper (Cu). Generally the conductive metal used should be electrochemically inert with respect to the materials used in the timer. In one embodiment, the conductive material is provided at a surface thickness of between about 500 Ångstroms (Å) and about 1,500 Å.

A sealing member 112 is provided having a sealing periphery 114 that defines an interior opening 116. Referring now to FIG. 1B, sealing member 112 is formed of any material suitable to create a substantially leak-proof seal with first and second surfaces 102 and 108 such that surfaces 102 and 108 and sealing member 112 define an interior cavity 117 dimensioned to house a gauge electrode 118 having an upper electrode surface 119, an electrolyte separator 120 having a surface 121, and an electrolyte solution. Materials suitable for sealing member 112 include polyethylene and commercially available materials such as those sold generally under the brands Surlyn® (DuPont de Nemours & Co., Wilmington, Del.) and Mactac® Morgan Adhesives Co., Stow, Ohio).

The electrolyte can be any material suitable to provide the desired electrochemical system. Thus, it will be appreciated that the electrolyte can be an aqueous or non-aqueous solution (e.g., hexane, toluene, ethylene or propylene carbonate) that is configured to be substantially non-corrosive to the other components of the timer. In one embodiment, the electrolyte includes zinc (Zn) salts such as zinc chloride ($ZnCl_2$), zinc triflate, or ammonium chloride ($NH_4Cl$). In one exemplary embodiment, the electrolyte comprises an aqueous $ZnCl_2$ solution. In another exemplary embodiment, the electrolyte is an aqueous zinc triflate solution.

Electrolyte separator 120 functions to allow selective passage of ions in the electrolyte solution between electrodes 108 and 118. Thus, the choice of materials for separator 120 will depend on the choice of materials for the electrodes and electrolyte solution. Examples of suitable materials for separator 120 include paper having sufficient mechanical durability in the electrolyte solution (e.g., rice paper), polyacrylamide gel, and the commercially available CELGARD® (Hoechst Celanese, Charlotte, N.C.).

In the illustrated embodiment, gauge electrode 118 is arranged substantially within the view of viewing port 106 and over the central area of electrolyte separator 120, which is dimensioned to fit within the cross section of the interior opening 116 of sealing member 112. As described in Section 4.4 below, gauge electrode 118 functions in conjunction with the surface 121 of electrolyte separator 120 to form a "progress indicator" of the electrochemical reaction between electrodes 118 and 110, during which reaction gauge electrode 118 is consumed at a predetermined rate when an electrochemical reaction is established between electrodes 118 and 110. The dissolution of material from gauge electrode 118 exposes the underlying surface 121 of the electrolyte separator. By choosing an electrode/electrolyte combination having suitable reaction rates, the disappearance of gauge electrode 118 during the electrochemical reaction with electrode 110 as viewed against the background provided by electrolyte separator surface 121 can be used as a measure of time. The choice and combination of electrode and electrolyte materials will be discussed in Section 4.3 below. The electrodes are formed using known methods and materials for the deposition of thin films, including, but not limited to, rolling, sputtering, printing, blade coating, plasma deposition, and the like. In one embodiment, the gauge electrode is deposited over the ITO-coated interior face of first surface 102.

In the embodiment shown in FIGS. 1A and 1B, gauge electrode 118 is deposited in an elongated shape having a substantially triangular cross-section (i.e., a linear deposition gradient) so that the electrode appears to be consumed in a direction progressing from the thinner end of the electrode to the thicker end of the electrode to provide a "countdown" timer. However, any deposition pattern can be applied that is suitable to achieve a desired visual effect. For example, a deposition pattern having a cross-sectional thickness greater in the center of the electrode would provide a visual effect in which the progress of the electrode's erosion would appear to converge on a central point or region. In another example, a deposition pattern that is substantially uniform in cross-section would provide a gradual uniform removal of the electrode. The shape provided for electrode 110 is arbitrary.

4.3 Combinations of Electrodes and Electrolytes

As discussed in Section 4.2 above, the present invention includes embodiments in which electrode 118 is consumed, or its state made otherwise visible (e.g., by color change) during an electrochemical reaction. Examples of useful materials for first electrode 108 include zinc (Zn), silver (Ag), copper (Cu), and lithium (Li). Examples of useful combinations of electrodes and electrolyte include those shown in Table 1 below. Still more examples will be familiar to those of skill in the electrochemistry arts [Cromptin, 1995 #1].

TABLE 1

| First Electrode Material | Second Electrode Material | Electrolyte |
|---|---|---|
| Zn | $MnO_2$ | $H_2O/NH_4Cl$ |
| Zn | Organo-Sulfur $(R_nS_m)_x$ | Propylene carbonate/zinc triflate |
| Ag | Zn | KOH |

The materials are combined in quantities sufficient to allow the substantially complete dissolution of gauge electrode 118 over a predetermined period of time. The choice of time period for dissolution is arbitrary, but useful periods include those on the order of minute, hours, days, or months. For example, 5-minute timer, 10-minute timer, 30-minute timers, and 60-minute timers each have utility for portable timer applications. Other possible periods include day-long and week-long timers.

In one embodiment, the activation of the timer is controlled by isolating the electrodes from electrochemical contact. In a particular embodiment, the isolation is achieved by storing the electrolyte in rupturable containers. One example of such an arrangement is provided in FIG. 2A. There, electrolyte 202 is sequestered in one or more rupturable capsules 204. In one more particular embodiment, described below in Section 4.4, sealing member 112 is chosen from a suitably resilient material that allows for the compression of the timer housing formed by surfaces 102, 108, and sealing member 112 at a pressure effective to rupture capsules 204 to release thereby electrolyte 202 and initiate the electrochemical reaction between electrodes 110 and 118.

Still other embodiments will be apparent to those of skill in the battery arts. For example, a single rupturable capsule can be used to hold electrolyte 202. Rupturing can be caused by the application of pressure as just described or by bending or twisting the timer housing. Alternatively, a plunger or the like can be used to puncture one or more electrolyte capsules to release the electrolyte. In another alternative embodiment, the electrolyte can be maintained in a separate capsule and injected or otherwise introduced into the interior of the timer housing.

In other alternatives, the electrolyte can be present, but electrical contact initiated by compressing the timer housing so that the conductive portions of the interior faces of surfaces 102 and 108 can be brought into conductive contact. In one embodiment, sealing member 112 is deformable so that conduction will be maintained after the initial downward pressure on the timer housing is released. In another embodiment, sealing member 112 is resilient and the electrical connection is maintained by the application of pressure. Continuous pressure can be maintained by an external clamp or the like. In still other alternative embodiments, the electrical connection can be external, e.g., a switch or other mechanism that creates an electrically conductive connection between surfaces 102 and 108. Examples of switches include mechanical switches as well as sensors, including, but not limited to, radiation sensors (UV, X-ray, IR, and visible light), temperature sensors, and the like. In addition, the conductive properties of the sealing member can be used to provide the electrically conductive connection. For example, polymers containing positive-temperature coefficient ("PTC") or negative-temperature coefficient ("NTC") materials such as those available commercially from under the tradename POLYSWITCH from Raychem Corporation (Menlo Park, Calif.).

4.4 Operation of the Electrochemical Timer of the Invention

Figure 2A:
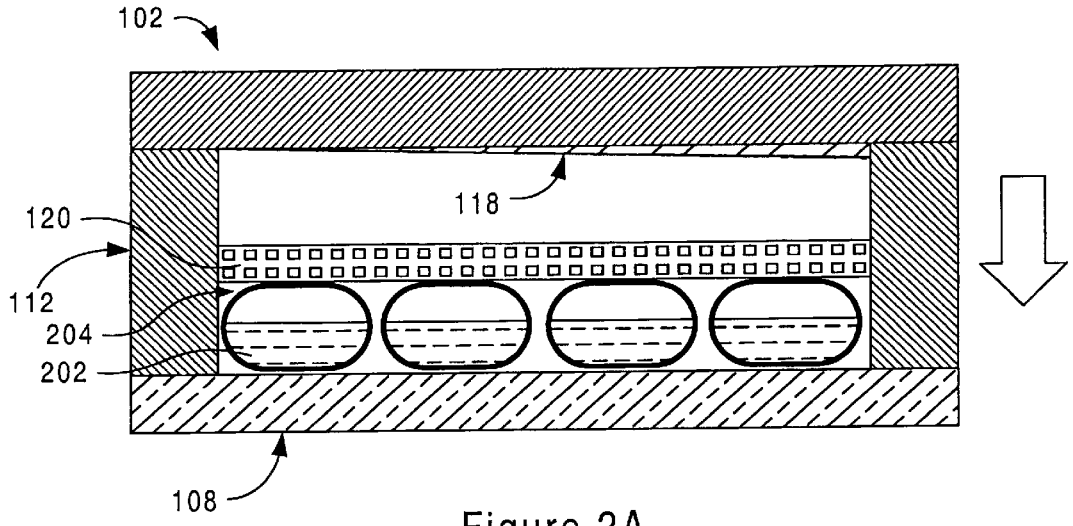
FIGS. 2A–2C illustrate in cross-section of the operation of an electrochemical timer in accordance with the present invention.
Figure 2B:
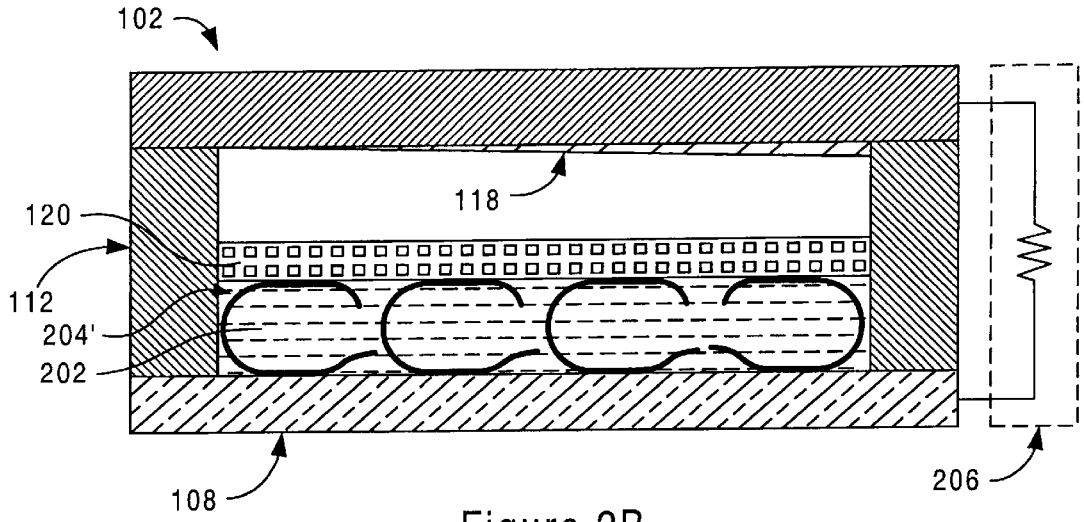
Figure 2C:
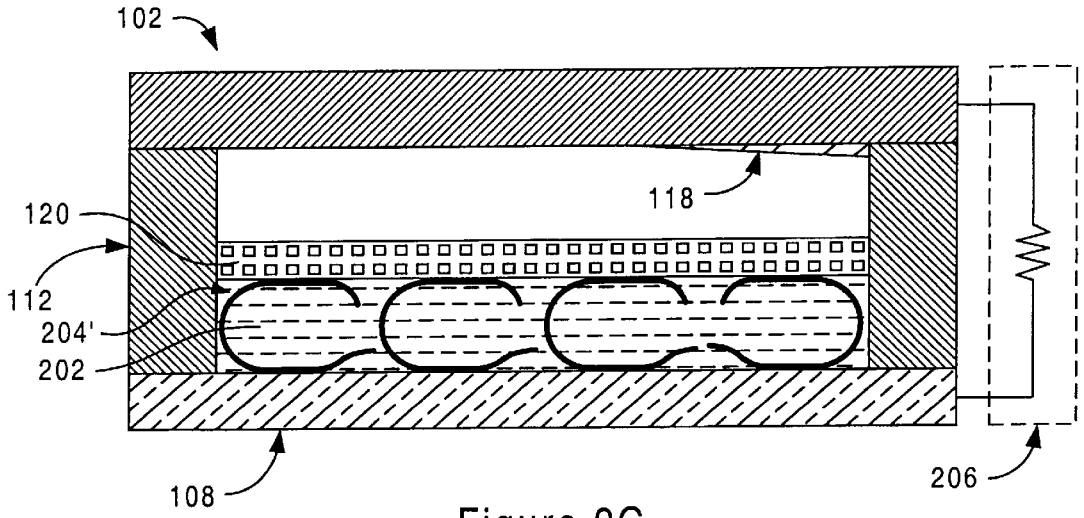
Figure 3A:
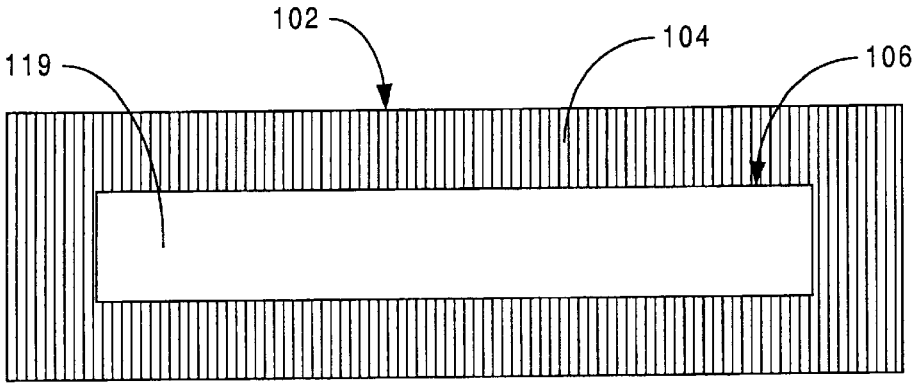
FIGS. 3A–3C illustrate the appearance of a viewing port during the operation of an embodiment of the present invention.
Figure 3B:
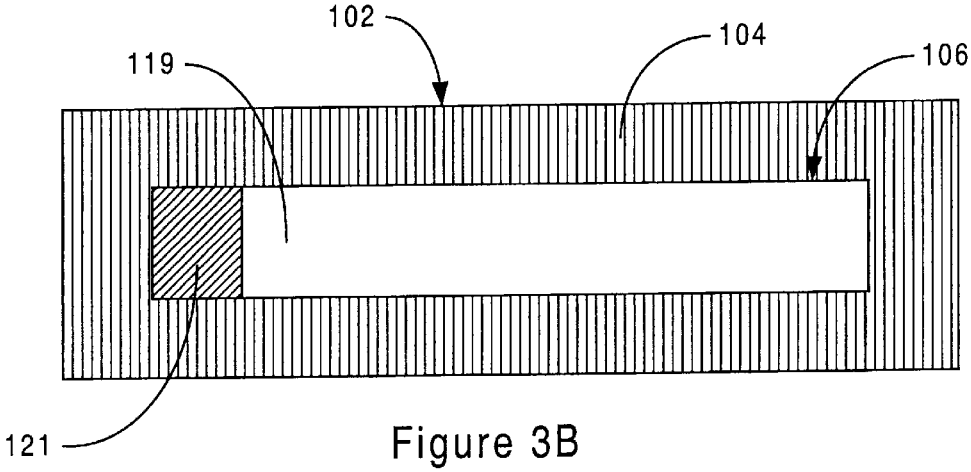
Figure 3C:
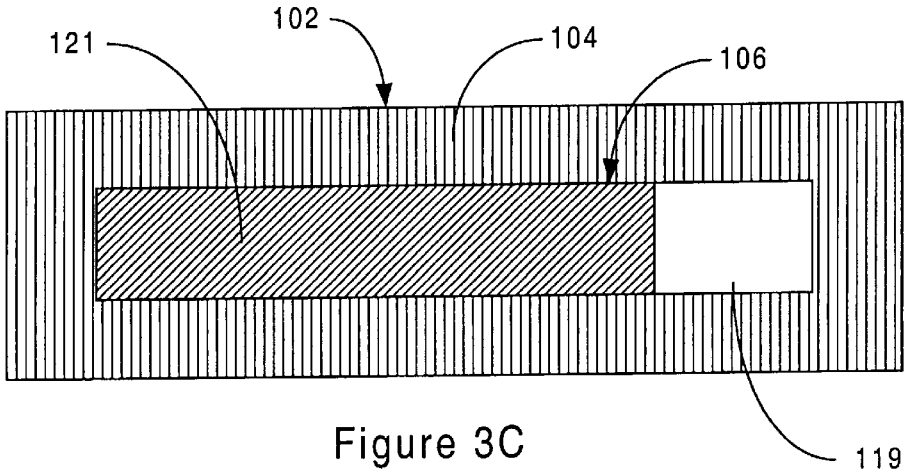

Operation of one embodiment of the invention will now be described with reference to FIGS. 2A–2C, FIGS. 3A–3C, and FIG. 4. FIGS. 2A–2C show a cut-away view of an electrochemical timer having the electrolyte retained in rupturable capsules as described with respect to FIGS. 1A and 1B above at three different operating points. FIG. 2A provides a view of the electrochemical timer of the invention prior to the initiation of operation, showing the electrolyte 202 retained in rupturable capsules 204. Sealing member 112 is suitably resilient or deformable such that the application of sufficient pressure to surface 102 of the timer housing, as indicated by the arrow, causes rupture of capsules 204 (shown at 204) thereby releasing electrolyte 202 as shown in FIG. 2B.

The release of the electrolyte in combination with an electrical resistance in the system (indicated generally by resistor 206) provides a current flow that causes the erosion of the gauge electrode as shown at 118' in FIG. 2C. The resistance can be any type of electrical resistance effective to cause a current flow from gauge electrode 118 to electrode 110. In one embodiment, the resistance is created by sealing material 112. In a more particular embodiment, the resistance of the sealing member is pressure activated. In another embodiment, the resistance is created by an external resistive element coupled with surfaces 102 and 108. In still another embodiment, the resistance value of the external resistive element is temperature- or pressure-sensitive.

The appearance of the timer to the user during various points of operation is illustrated in FIGS. 3A–3C and 4. Starting at FIG. 3A, the arrangement of gauge electrode 118 directly beneath viewing port 106 provides an initial view in which electrode surface 119 substantially fills port 106 prior to initiation of current flow. This status corresponds to FIG. 2A. Upon initiation of the electrochemical reaction (e.g., by release of electrolyte as discussed with reference to FIG. 2B), electrode 118 begins to erode and, after a passage of time, electrolyte separator surface 121 begins to appear in port 106 in those regions where electrode 118 is relatively thinly deposited. Continued current flow causes further erosion of electrode 118 such that at still later times a greater portion of viewing port 106 is taken by electrolyte separator surface 121. This is illustrated FIG. 3C, which corresponds to the operatin point shown in FIG. 2C. Finally, at the end of the electrochemical reaction (i.e., the end of the timing period as measured by the consumption of the gauge electrode), viewing port 106 shows only surface 121.

Figure 4:
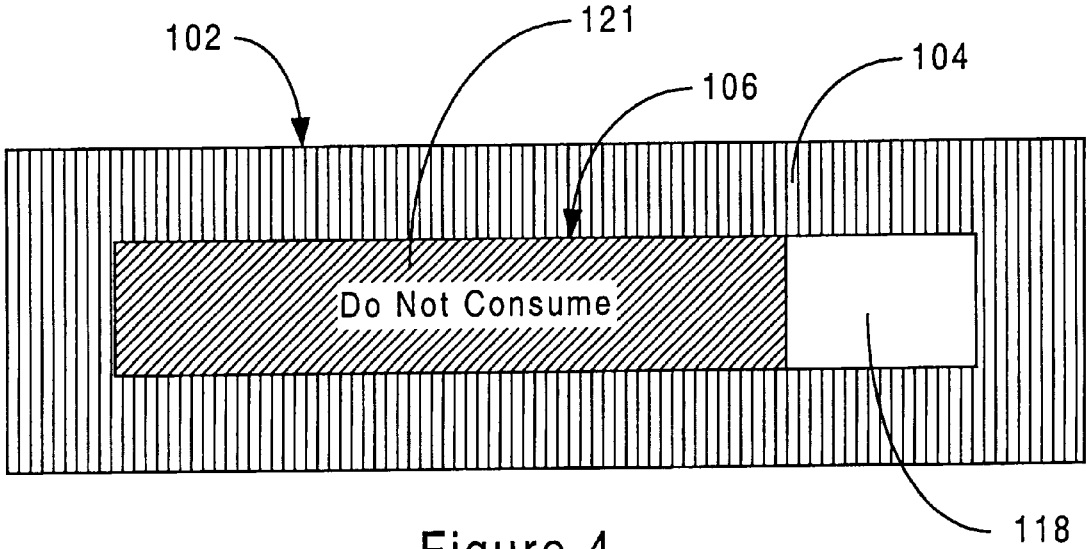
FIG. 4 illustrates the appearance of a viewing port during the operation of an embodiment of the present invention in which the progress bar includes a message.

Surface 121 can be provided with any of a variety of colors, patterns, and/or messages that are exposed as the electrochemical reaction proceeds. The placement of such colors, patterns, and/or messages will be familiar to those of skill in the art. One example of a message is shown in FIG. 4. There, the message "Do Not Consume" is fixed to surface 121 and is fully displayed at a very late point in the progression of the timer. Such a message can be used in combination with foodstuffs to warn consumers that food sold in conjunction with the timer may have spoiled.

4.5 Applications of the Electrochemical Timer of the Invention

Figure 5A:
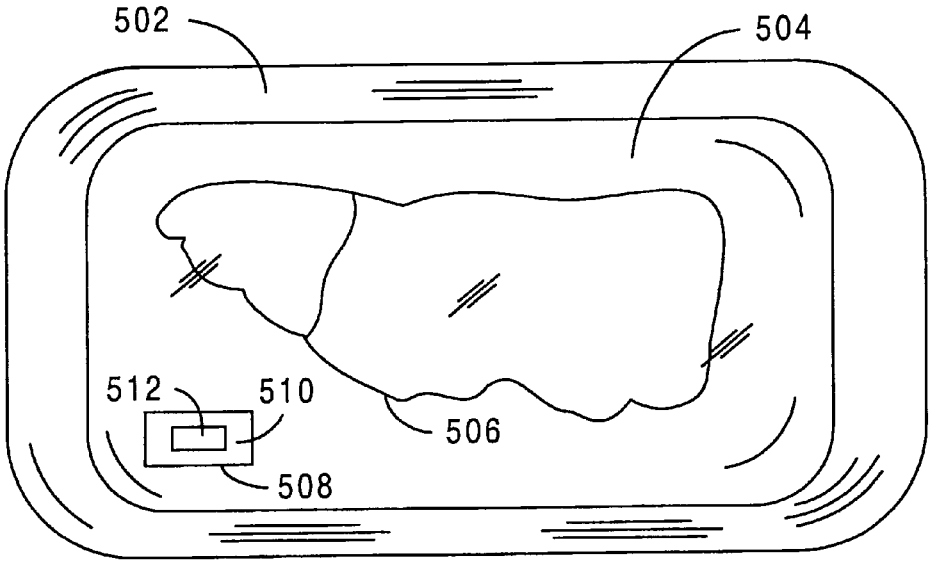
FIGS. 5A–5C illustrate the use of an electrochemical timer in accordance with the present invention as a meat freshness indicator.
Figure 5B:
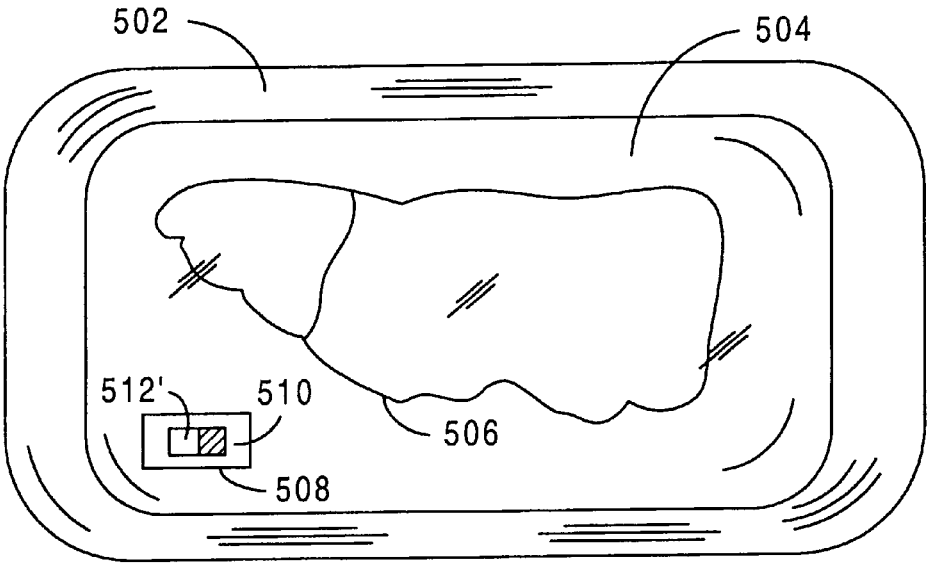
Figure 5C:
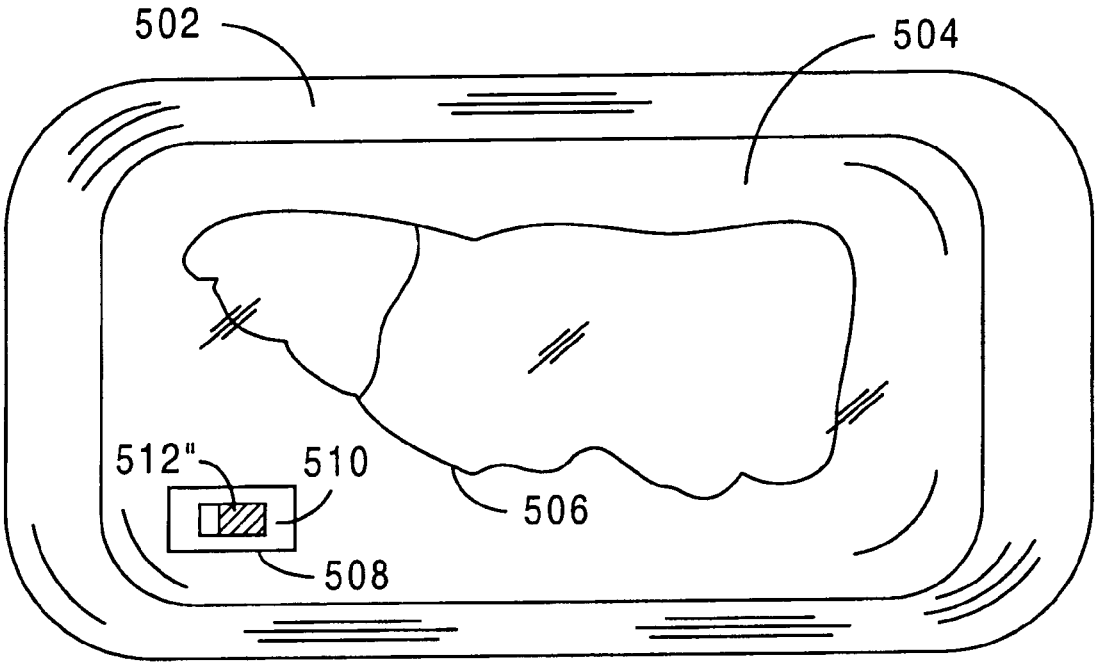

FIGS. 5A–5C illustrate the use of the electrochemical timer of the invention as an indicator of food freshness. In such an application, the electrochemical timer of the invention is coupled with the container of the food being monitored or sold using any suitable means that allows visual access to the viewing port (e.g., adhesive, clamp, rivet, collar, magnet, or the like). The timer is activated in any manner consistent with its design (e.g., by pressure activation), either before or after attachment to the foodstuff container, and monitored either by shipping or sales personnel, or by consumers at the point of purchase.

FIG. 5A illustrates one such container. There, a food tray 502 includes a window 504 (either created by transparent wrapping over tray 502 or by a window coupled with tray 502). Tray 502 holds foodstuff 506. Attached to window 504 is electrochemical timer 508 having surface 510 and viewing port 512. Timer 508 is activated, either during processing, shipping, or at the point of sale, upon which activation the gauge electrode begins to erode and the surface of the underlying electrolyte separator begins to appear as shown in FIG. 5B at 512'. As the timer reaches the end of its operational limit, the viewing port is almost filled with the image of the surface of the electrolyte separator as shown in FIG. 5C at 512". As noted above, the surface of the electrolyte separator can also include a message such as "Do Not Consume" or "Expired" or the like to warn consumers or monitors that the shelf-life of the foodstuff has expired. In one embodiment, timer 508 is coupled with a temperature-sensitive resistor so that the rate of expiration of timer 508 is faster when the food is placed in warmer conditions than in colder conditions.

The electrochemical timer of the present invention can be used in many other applications as well. For example, the timers of the present invention can be attached to folders holding time-sensitive documents to provide an immediate visual indication of deadlines related to the documents. The timers of the present invention can also be used in lieu of parking meters. In this application, the right to park in a metered space for a period of time (e.g., one hour) can be obtained by purchasing a timer having a duration at least equal to that of the parking period. When the owner of the timer wants to use a public space she parks in the space, activates the timer, and displays the timer so that traffic control officers can note the status of the timer. Such an application could be addressed using a timer that can be stopped and re-started so that remaining time after parking at a first location is available to the owner for other parking at a second location.

Thus, the present invention will be seen to provide a compact, lightweight, highly portable, and substantially accurate device for monitoring the process of chronological periods. Using the device of the invention time-sensitive materials, such as foodstuffs, can be monitored.

Although specific embodiments and examples have been described herein, those of skill in the electrochemical arts will appreciate that many variation can be made to the described embodiments and examples without departing from the spirit and scope of the invention. For example, many materials can be used in the manufacture of the components of the timer housing in addition to those specifically recited herein based on the general properties described above. Those of skill in the electrochemistry arts will further understand there are many electrochemical systems that are compatible with the present invention beyond those mentioned herein. Furthermore, there are many additional applications will be apparent based on the general teachings provided regarding the use of adhesives to affix timers of the invention to various items. These applications may include additional circuit mechanisms in addition to those discussed above. Such applications and modifications, however, will be seen to be within the scope of the teachings provided herein as understood by those of skill in the electrochemical arts.

What is claimed:

1. An electrochemical timer, comprising a first electrode having a viewable area, an electrolyte, and a second electrode said first and second electrodes and said electrolyte being chosen such that when said first and second electrodes and said electrolyte are brought into electrochemical contact, said first electrode is consumed at a predetermined rate during the period of such electrochemical contact, and further wherein said first and second electrodes and said electrolyte are configured such that said consumption of said first electrode can be monitored using the viewable area of said first electrode during said electrochemical contact to provide a continuous indication of the passage of time, wherein the viewable area of said first electrode begins to change when electrochemical contact is made.

2. The electrochemical timer of claim 1, further comprising means for isolating said first electrode from electrochemical contact with said second electrode to prevent thereby consumption of said first electrode.

3. The electrochemical timer of claim 2, wherein said means for isolating said electrodes comprises a container for holding said electrolyte, wherein substantial electrochemical contact between said electrodes is prevented while said electrolyte is retained in said container and electrochemical contact between said electrodes is enabled when said electrolyte is released from said container.

4. The electrochemical timer of claim 3, wherein said container comprises a rupturable capsule disposed between said first and second electrodes.

5. The electrochemical timer of claim 1, further comprising a resistor.

6. The electrochemical timer of claim 5, wherein said resistor is temperature sensitive.

7. The electrochemical timer of claim 5, wherein said resistor is pressure activated.

8. The electrochemical timer of claim 1, wherein said first and second electrodes and said electrolyte are arranged within the interior of a timer housing, said timer housing including a window for viewing the consumption of said first electrode when said first and second electrodes are in electrochemical contact with said electrolyte.

9. The electrochemical timer of claim 8, further comprising a container for isolating said electrolyte from said first and second electrodes, said container being arranged within said timer housing.

10. The electrochemical timer of claim 9, wherein said container is rupturable.

11. The electrochemical timer of claim 10, further comprising a resistor.

12. The electrochemical timer of claim 11, wherein said resistor is temperature sensitive.

13. The electrochemical timer of claim 11, wherein said resistor is pressure activated.

14. The electrochemical timer of claim 11, wherein said resistor is external to said timer housing.

15. The electrochemical timer of claim 11, wherein said resistor is internal to said timer housing.

16. The electrochemical timer of claim 8, wherein said housing comprises first and second surfaces in sealing contact with a sealing member such that said first and second surfaces and sealing member define an interior cavity dimensioned to contain said electrodes and said electrolyte.

17. The electrochemical timer of claim 16, wherein said first and second electrodes are arranged and dimensioned such that the consumption of said first electrode can be observed through said window during said electrochemical reaction between said first and electrodes to provide thereby a measure of the passage of time.

18. The electrochemical timer of claim 17, wherein said electrolyte is stored in a electrolyte container arranged in said interior cavity, said electrolyte container being configure to release said electrolyte and initiate said electrochemical reaction between said first and second electrodes in response to the application of pressure to said timer housing.

19. The electrochemical timer of claim 18, wherein a perceptible message appears in said viewing port during the consumption of said first electrode during said electrochemical reaction between said first and second electrodes.

20. The electrochemical timer of claim 1, wherein said first electrode is a thin film electrode.

21. The electrochemical timer of claim 20, wherein the thin film is formed using physical vapor deposition, sputtering, printing, rolling or plasma deposition.

22. The electrochemical timer of claim 16, wherein the first surface is between 5–25 micrometers thick.

23. The electrochemical timer of claim 16, wherein an interior of at least one of the first surface and an interior of the second surface is coated with a conductive film.

24. The electrochemical timer of claim 23, wherein the thickness of the conductive film is between 500 and 1500 angstroms.

25. The electrochemical timer of claim 23, wherein the conductive film is indium tin oxide, nickel or copper.

26. The electrochemical timer of claim 23, wherein said first electrode is deposited over the conductive film.

27. The electrochemical timer of claim 1, wherein said first electrode is wedge shaped.

28. A method for providing an indication of increased risk of food spoilage, comprising the steps of:

a. providing a perishable foodstuff in a foodstuff container;

b. affixing to said foodstuff container an electrochemical timer that includes first and second electrodes and an electrolyte contained in a timer housing such that upon activation of said electrochemical timer said first electrode is consumed over a period that corresponds substantially to the shelf-life of said perishable foodstuff, said electrochemical timer further including a warning indicator that becomes perceptible as said first electrode is consumed; and c. activating said electrochemical timer to initiate said electrochemical reaction such that said warning indicator is perceptible upon the substantial completion of said electrochemical reaction between said first and second electrodes to indicate thereby said perishable foodstuff is at a greater risk of spoilage.

* * * * *